United States Patent [19]

Miyabayashi

[11] Patent Number: 4,974,541

[45] Date of Patent: Dec. 4, 1990

[54] IMAGE FORMING APPARATUS UTILIZING WET TYPE DEVELOPMENT

[75] Inventor: Takeshi Miyabayashi, Nagoya, Japan

[73] Assignee: Brother Kogyo Kabushiki Kaisha, Aich, Japan

[21] Appl. No.: 425,951

[22] Filed: Oct. 24, 1989

[30] Foreign Application Priority Data

Oct. 28, 1988 [JP] Japan ..... 63-274254
Oct. 28, 1988 [JP] Japan ..... 63-274255
Oct. 31, 1988 [JP] Japan ..... 63-142670[U]

[51] Int. Cl.[5] ..... G03G 15/10

[52] U.S. Cl. ..... 118/659; 118/300; 355/256; 354/317; 354/325

[58] Field of Search ..... 118/659, 660, 300; 355/256, 258, 326, 327; 354/323, 325, 317

[56] References Cited

U.S. PATENT DOCUMENTS 3,084,063 4/1963 Barnes et al. ..... 118/300 X
3,377,938 4/1968 Patterson ..... 118/300 X

*Primary Examiner*—R. L. Moses
*Attorney, Agent, or Firm*—Oliff & Berridge

[57] ABSTRACT

An image forming apparatus for coating a recording medium having a latent image thereon with toners and other materials for latent image development, including: a reservoir for separately preserving a first solution including the toners and a second solution including the other materials when the apparatus is not used, and a spray head for mixing the first and second solutions to form a wet toner solution and spraying the wet toner solution of the recording medium to thereby develop the latent image when the apparatus is used.

10 Claims, 4 Drawing Sheets

IMAGE FORMING APPARATUS UTILIZING WET TYPE DEVELOPMENT

BACKGROUND OF THE INVENTION

This invention relates to an image forming apparatus, and more particularly to an image forming apparatus utilizing wet type development.

In a conventional image forming apparatus such as a copying machine, a latent image is formed on a photosensitive medium by applying light through an optical lens on the medium or irradiating a laser beam thereon to induce a voltage difference on the surface of the medium, and then is developed by adhering toners to the medium. In order to develop the latent image, a dry type development or a wet type development has been mainly adopted in the conventional image forming apparatus. As the wet type development, a conductive ink development method, a selective damping method, a cyst development method, a magnetic fluid method, etc. have been conventionally adopted.

In the conventional image forming apparatus utilizing the wet type development, an uniformly-charged recording medium, which has been exposed to light or supplied with an electrostatic field to form an electrostatic latent image, is supplied with wet type toners by an adhering device, and then is subjected to a heat treatment or the like to fix the toners to the recording medium and form an original image on the recording medium. Such a wet type image forming apparatus has the following disadvantages: an image of high resolution is more easily obtained than in a dry type image forming apparatus because the wet type toners are used in a state where they are resolved in a solvent, and a image is more clearly obtained when a solvent having low affinity to the recording medium is used because the substantially spherical toners are thickly adhered even to those fine regions of the recording medium where a minute latent image is formed. However, the solvent having low affinity to the recording medium ordinarily has a lower capability for preservation of the toners. That is, the toners would be denatured when they are preserved in the solvent for a long time.

Moreover, since a hardener and a vehicle are further mixed with a solution of the toners and the solvent, the mixed solution is difficult to due to the mixing of those materials even though the solvent has no bad effect on the preservation of the toners. As a result, an utilization efficiency of the charged toners and so on is lowered and a running cost becomes higher.

SUMMARY OF THE INVENTION

This invention has been made to overcome the above difficulties of the conventional image forming apparatus, and has an object to provide an image forming apparatus utilizing wet type development, which is capable of making the running cost and maintenance of the apparatus lower and easier, and in which those components that have a bad effect on the preservation of toners are preserved separately from the toners when the image forming apparatus is not used, and are mixed with the toners when the image forming apparatus is used.

According to one aspect of this invention, the image forming apparatus for attaining the above object includes a reservoir for preserving a first solution including toners separately from a second solution including other materials for latent image development and a developing unit for mixing the first and second solutions to form a wet toner solution and spraying the wet toner solution on the recording medium where a latent image is formed.

According to another aspect of this invention, the image forming apparatus further comprises a withdrawing unit for withdrawing a surplus wet toner solution on the recording medium and returning the surplus wet toner solution to the reservoir.

DETAILED DESCRIPTION OF THE INVENTION

The preferred embodiments of this invention will be described hereunder with respect to the accompanying drawings.

The following embodiments will be representatively described for two cases. One is a case where a solvent having low affinity to a recording medium has a bad effect on preservation of toners, in other words, the solvent and the toners are preserved separately from each other when the image forming apparatus is not used and are mixed with each other when the apparatus is used, and the other is a case where one of a hardening agent (hardener) and a vehicle agent (vehicle) or the mixing thereof has a bad effect on the preservation of the toners, in other words, the toners and one of the hardening and vehicle agents are preserved separately from each other when the image forming apparatus is not used and are mixed with each other when the apparatus is used.

In the following embodiments, two types of reservoirs will be described in correspondence to the above two cases. However, the reservoir of this invention is not limited to the above types, and various modifications to the reservoir may be made in accordance with the materials to be separately preserved in the reservoir.

In the following embodiments, a laser irradiation method is adopted as a device for forming a latent image on a recording medium. However, this invention is not limited thereto. Other methods such as an electrostatic method or the like may be used.

A recording medium used in the following embodiments is a roll type sheet including an aluminum layer which is deposited on the sheet, and a n-type semiconductor layer such as titanium oxide powder or the like which is coated on the aluminum layer.

Figure 1:
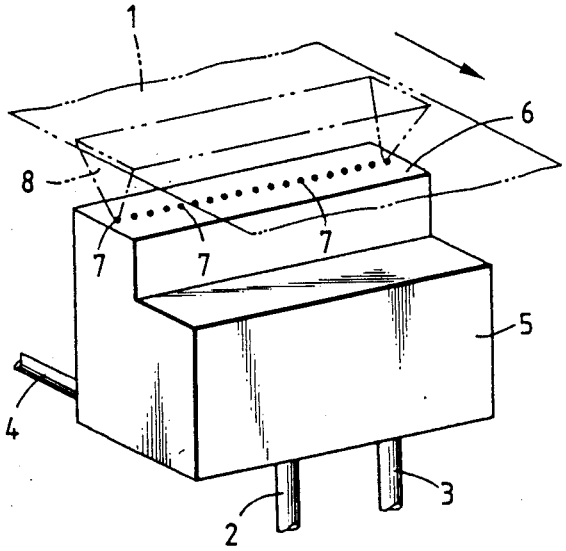
FIG. 1 shows one embodiment of a spray head for mixing a toner solution and other materials for development of a latent image to form a wet toner solution and spraying the wet toner solution on a recording medium.

FIG. 1 shows one embodiment of a developing unit for mixing a toner solution and other materials for development of a latent image to form a wet toner solution and spraying the wet toner solution on a recording medium. The developing unit includes a spray head 5 for mixing the toner solution and the other materials, an air hose 4 connected to a compressor (not shown) for sending a compressed air to the air hose 4, and two hoses 2 and 3 for receiving the toner solution and the other materials, respectively. Plural nozzles 7 are formed on the top surface of the spray head to spray the mixed (wet toner) solution 8 on the surface of a recording medium 1.

Figure 2:
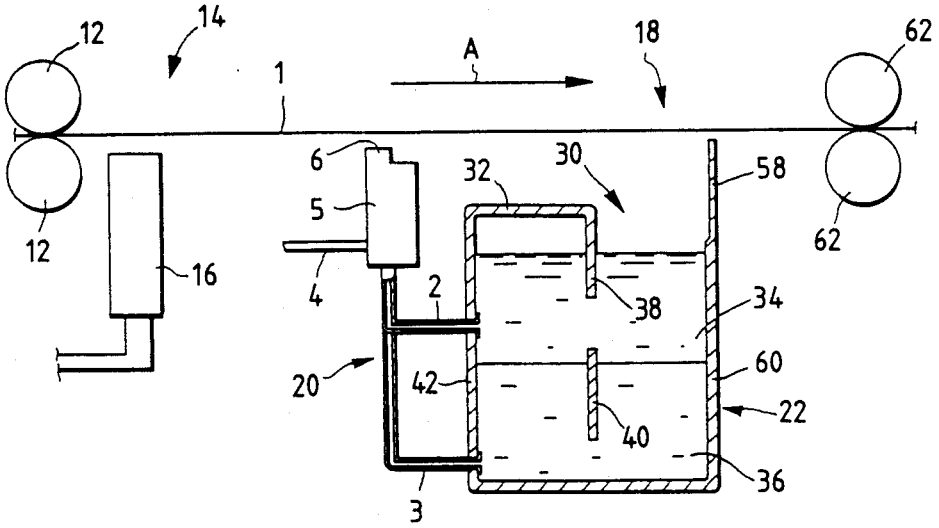
FIG. 2 shows a first embodiment of the image forming apparatus according to this invention.

FIG. 2 shows a first embodiment of the image forming apparatus according to this invention.

A recording medium 1 is charged by a charging device (not shown) and then is fed through a pair of rollers 12 to a latent image forming portion 14 in which an electrostatic painting head 16 for forming a latent image on the recording medium 1 (hereunder referred to as a painting head) is provided. The painting head 16 converts an electrical signal transmitted from an image pickup device (not shown) into a laser beam having information of the electrical signal and applies the laser beam to the surface of the recording medium 1 to form the latent image corresponding to an original image. The charges, which have been supplied to the surface of the recording medium 1 by the charging device, are eliminated at the regions where the laser beam is applied and remain at the other regions where the laser beams are not applied (that is, the latent image is formed). The recording medium 1 on which the latent image has been formed is fed to a development portion 18 and is developed therein. The development portion 18 includes a development device comprising a reservoir 22 for separately preserving a toner solution and the other materials for latent image development from each other and a spray head for mixing the toner solution and the other materials to form a wet toner solution for development and spraying the wet toner solution on the surface of the recording medium 1. The recording medium thus developed is fed to a pair of feeding rollers 62 so as to be subjected to a fixing treatment.

The image forming apparatus according to this invention can be used not only to form a monochromatic image, but also to form a color image. The operation of the image forming apparatus according to this invention will be described particularly for a case where a color image is formed on a recording medium.

Four colors of yellow, magenta, cyan and black are used to form a color image on a recording medium, and the respective color latent images thereof are superposedly formed on the recording medium to finally obtain the color image.

First, a yellow latent image is formed on the recording medium 1. The recording medium 1 on which the yellow latent image has been formed is fed to the development portion 18 is fed to the development portion 18. In this case, four development devices for the respective colors, each development device comprising a reservoir and a spray head, are provided in the development portion 18, and only a development device for yellow color is representatively shown in FIG. 2. The reservoir 22 of the development device 20 is designed such that the top surface of the reservoir 22 confronts the front surface of the recording medium 1 on which the latent image is formed. As shown in FIG. 2, one portion of the top surface of the reservoir 22 is opened to the surface of the recording medium 1, while the other portion is closed to the surface of the recording medium 1 by a closing plate 32. The reservoir 22 accommodates a first solution 34 and a second solution 36 for developing the yellow latent image, and has two partitioning plates 38 and 40 fixedly mounted to a pair of walls of the reservoir 22 which are opposite to each other. The partitioning plate 38 is connected to the closing plate 32 to prevent foreign matters from being injected into or mixed with the first and second solutions.

The first solution 34 is a lipophilic solution including a xylene solvent having low affinity to the recording medium 1 and a vehicle of alkyd resin solved in the xylene solvent, and the second solution 36 is a hydrophilic solution including a solvent of ethylene glycol and yellow toners solved in the ethylene glycol solvent. Those solutions are naturally separated into two phases in the reservoir 22 because of their opposite properties, that is, the lipophilic and hydrophilic properties. In this case, the first and second solutions 34 and 36 are separated from each other such that the first solution 34 is above the second solution 36. The toners are in a good preservation in the ethylene glycol, and therefore are not denatured when preserved in the ethylene glycol solvent.

As shown in FIG. 2, throughholes are formed at two positions of one side wall of the reservoir 22, the first throughhole being formed slightly above the center of the wall and the second throughhole being formed near to the bottom of the reservoir 22. The free ends of the hoses 2 and 3 are tightly inserted into the first and second throughholes respectively, so that the first and second solutions 34 and 36 are sucked up through the first and second throughholes to the spray head 5, respectively.

As described above, the plural nozzles are formed at the top surface of the spray head in such a manner that those nozzles are aligned with one another. The mixed (wet toner) solution of the first and second solutions 34 and 36 are sprayed on the recording medium 1 through the nozzles. In this embodiment, the spray head 5 is provided with an air hose 4 whose free terminal is connected to an air source such as a compressor, and is provided therein with an air passage intercommunicating the air hose 4. The air passage branches into plural branch passages in the spray head and the branch passages intercommunicate the respective nozzles. Similarly, the spray head 5 is also provided therein with solution passages for the first and second solutions 34 and 36 which intercommunicate the first and second hoses 2 and 3, and each of the solution passages branches into plural branch solution passage which intercommunicate the respective nozzles. Accordingly, when the air is supplied to the spray head 5 by the air source, the first and second solutions 34 and 36 in the reservoir 22 are independently sucked up and supplied to the spray head 5 and are mixed in the nozzles, so that a mixed wet toner solution is sprayed on the recording medium 1. In this embodiment, three passages for the air and the first and second solutions are provided in the spray head. However, as described later, it is possible to provide only one passage in which the air and the first and second solutions are mixed with one another and at the same time the mixed wet toner solution is sprayed on the recording medium 1.

Figure 3:
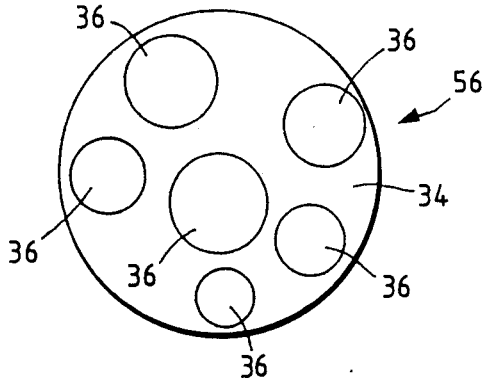
FIG. 3 shows a mixing state of a granular wet toner solution of toner solutions and a solvent having low affinity to a recording medium, which are sprayed by a spray head.

The first and second solutions 34 and 36 thus suck up are mixed with each other in the spray head 5 to form a wet toner solution and the wet toner solution is to be sprayed on the recording medium 1 through the nozzles. The wet toner solution has a mixing state as shown in FIG. 3 in which fine particles of the second solution 36 are separately dispersed in the first solution 34 in a phase-separation state. When sprayed on the recording medium 1, those particles of the wet toner solution 56 are attached to the surface of the recording medium 1. The nozzles are formed on the top surface of the spray head at short intervals within a smaller region than the width of the recording medium 1 as shown in FIG. 1, so that the wet toner solution is prevented from scattering to the rear surface of the recording medium 1 and is accurately attached to the front surface thereof. Further, a supply ratio of the first and second solutions 34 and 36 to the spray head (or, a mixing ratio of the first and second solutions in the spray head) is predetermined to a constant value in accordance with the structure of the spray head 5, so that the wet toner solution 56 of constant density is sprayed on the recording medium 1 every time the air is supplied to the spray head 5.

When the first and second solutions 34 and 36 are depleted in the reservoir 22, those solutions are replenished through the opening portion 30 of the reservoir 22 until the amount of the solutions reaches a prescribed value. In this case, the replenished first and second solutions 34 and 36 are separated from each other, so that those solutions are separately preserved in the reservoir 22 and the first and second solutions 34 and 36 are not sucked up through the second and first hoses 3 and 2, respectively.

After the wet toner solution is attached to the recording medium 1, a surplus wet toner solution is removed from the recording medium 1 by a withdrawing unit such as a scraper. The scraper of this embodiment comprises a projection plate 58 formed integrally with and projecting upwardly from one side wall of the reservoir 22 which confronts the opening portion 30 of the reservoir 22, and is designed so that the tip of the projection plate 58 scrapes off the surplus wet toner solution on the recording medium 1. Accordingly, the recording medium 1, after provided with the wet toner solution, is fed in the direction as indicated by the arrow A by a pair of rollers 62, and the surplus wet toner solution is scraped off by the projection plate 58. The scraped wet toner solution 56 drops down through the scraper 58 to the opening portion 30 of the reservoir 22. The wet toner solution 56 returned to the reservoir 22 is phase-separated into the first and second solutions and the second solution is preserved at the lower portion of the reservoir 22.

Figure 4A:
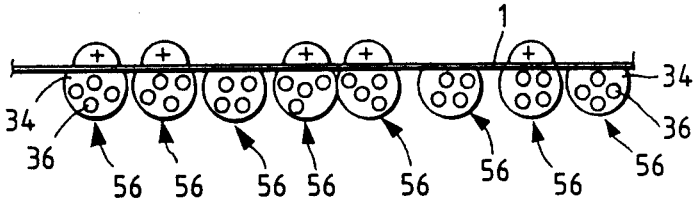
FIG. 4(A) shows a recording medium to which the wet toner solution is attached.
Figure 4B:
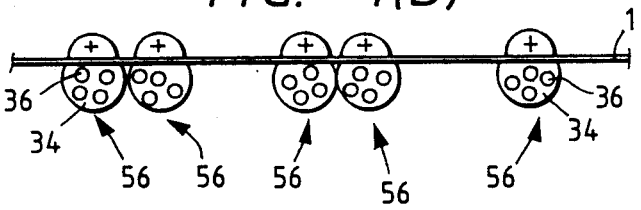
FIG. 4(B) shows the recording medium after the surplus wet toner solution is scraped and removed.

As described above, the wet toner solution which has been attached to the recording medium 1 as shown in FIG. 4(A) is removed at the region where the laser beam is applied by the painting head 16, and remains at the region where no laser beam is applied. Accordingly, as shown in FIG. 4(B), the wet toner solution is fixedly attached only to the charged region of the recording medium 1, while not attached to the uncharged region. In this case, the wet toner solution formed by mixing the first and second solution 34 and 36 has low affinity to the recording medium 1 because the first solution 34 itself has low affinity of the recording medium 1. Accordingly, the wet toner solution 56 is attached to the recording medium 1 in a substantially granular state as shown in FIG. 3, and therefore a sufficient amount of the wet toner solution is attached to a minute charged region of the recording medium 1. A particle size of the wet toner solution 56, although dependent upon the size of the nozzles of the spray head 48, may be adjusted to be 1 to 10 $\mu$m.

Figure 4C:
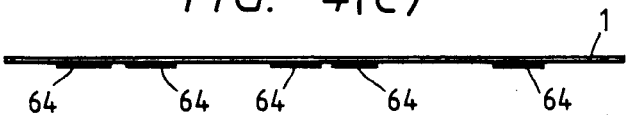
FIG. 4(C) shows the recording medium after being heat-fixed.

The recording medium 1 provided with the wet toner solution 56 at the charged region thereof is fed through a gap between the rollers 62 to a heat fixing portion (not shown). In the heat fixing portion, the recording medium 1 is subjected to a heat fixing treatment and the yellow toner 64 is fixedly attached to the charged region of the recording medium 1 as shown in FIG. 4(C), so that a yellow image 64 is formed. The recording medium 1 having the yellow image 64 thereon is rewound to an initial position, and is repeatedly subjected to charging, latent image forming, developing and heat fixing processes as described above for each of the remaining colors of cyan, magenta and black, and an original color image is formed on the recording medium 1.

As described above, in this embodiment the reservoir 22 is used to preserve the first and second solutions in one space, and therefore the image forming apparatus of this embodiment requires only a small number of parts and a small size of space in which the reservoir is disposed. This enables the image forming apparatus to be miniaturized. Further, provision of the scraper for withdrawing the surplus wet toner solution enables the used wet toner solution to be reused, so that a cost is more reduced in comparison with a case where the wet toner solution can not be reused.

When the withdrawal of the wet toner solution is not required, two containers may be provided to independently preserve the first and second solutions in place of the reservoir of this embodiment. In this case, the first and second solutions are not necessarily required to have the lipophilic property and the hydrophilic property, respectively, insofar as the first solution has low affinity to a recording medium and the second solution preserves the toner solution without denature of the toner solution.

Further, in place of xylene, isoparaffin may be used as a solvent for the first solution. Melamine resin may be used as a vehicle, but is not necessarily indispensable.

Figure 5:
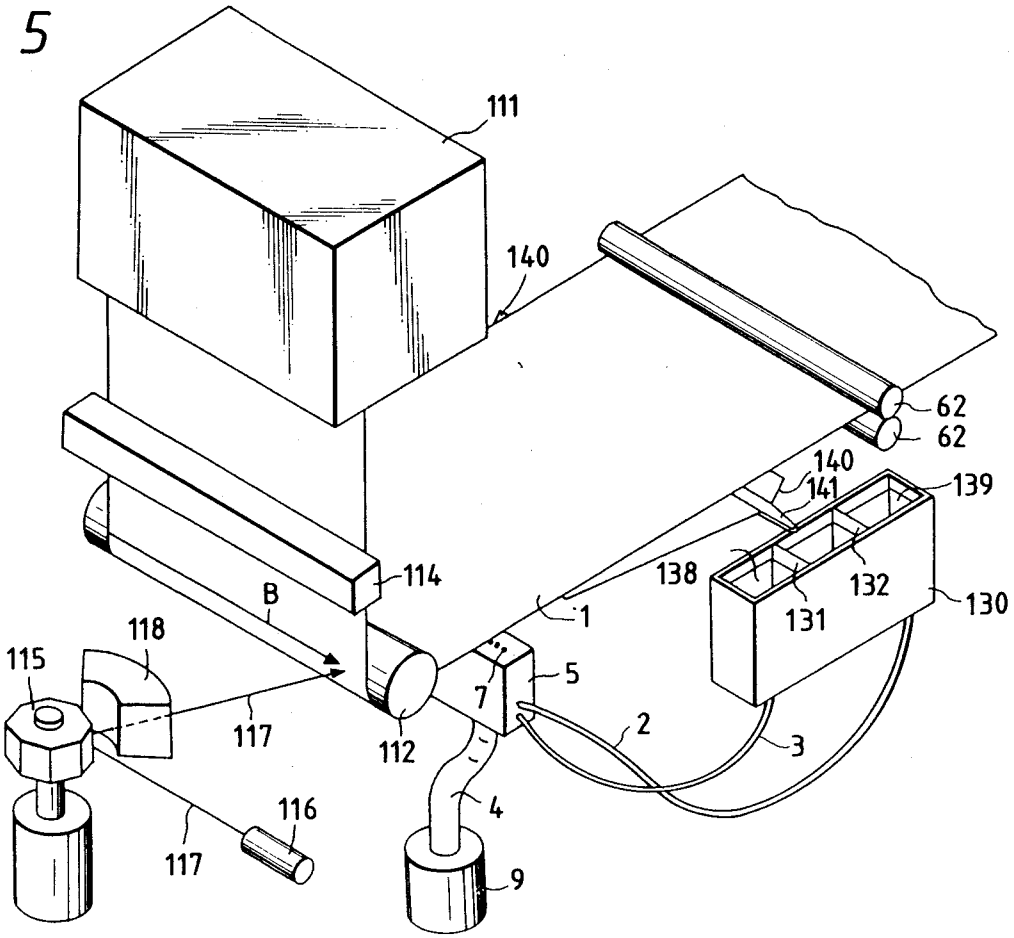
FIG. 5 is a perspective view of a second embodiment of the image forming apparatus according to this invention.
Figure 6:
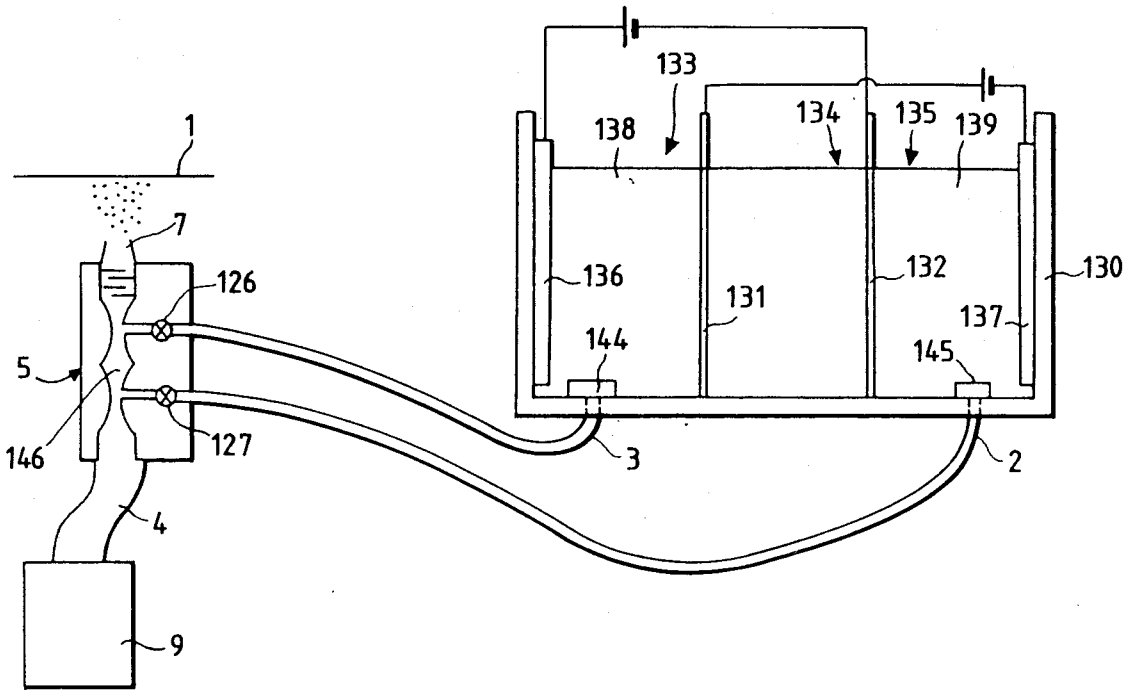
FIG. 6 is cross sectional views of a reservoir and a spray head used in the image forming apparatus as shown in FIG. 5.

FIG. 5 shows another embodiment of the image forming apparatus according to this invention, and FIG. 6 is cross sectional views of a reservoir and a spray head used in the image forming apparatus as shown in FIG. 5. The same elements as those in FIGS. 1 and 2 are designated by the like reference numerals, and the detailed description thereof is eliminated.

Like the image forming apparatus as shown in FIG. 2, a recording medium 1 comprising a roll type sheet which is accommodated in a cartridge 111 is fed to a platen 112 disposed below the cartridge 111, and is deflected in the horizontal direction to a development portion. A charging device 114 such as a corotron is disposed between the cartridge 111 and the platen 112, and a painting head for forming a latent image on the recording medium 1 is disposed at the opposite side to the development portion with respect to the platen 112. The painting head of this embodiment comprises a semiconductor laser oscillator 116 for emitting a laser beam 117, a polygon mirror 115 for reflecting the laser beam 117 to the surface of the recording medium 1, and an F$\theta$ lens 118 disposed between the polygon mirror 115 and the recording medium 1. The laser oscillator 116 is controlled by a controller (not shown) to be set into oscillation in synchronism with the rotational motion of the polygon mirror 115 in accordance with an image which is memorized in a frame memory (not shown). The laser beam emitted from the laser oscillator 116 is reflected from the polygon mirror 115 and applied to the recording medium 1 at the position where the recording medium 1 is wound around the platen 112.

Like the first embodiment of the image forming apparatus, the development portion includes a spray head 5 disposed below the recording medium 1 which is fed from the platen 112 to rollers 62, a reservoir 130 for preserving a toner solution and other materials for development of a latent image and a withdrawing unit for withdrawing a surplus wet toner solution from the recording medium 1 and returning it to the reservoir 130. As described in the first embodiment, the spray head 130 has plural nozzles 7 formed on the top surface thereof such that they are aligned with one another in the traverse direction of the recording medium 1 and three hoses 2, 3 and 4. The hose 4 is connected to a compressor 9 and supplies a compressed air therethrough to the spray head 5. In the spray head 5, two kinds of solutions which are supplied from the reservoir 130 through the hoses 2 and 3 are mixed with each other and is sprayed on the recording medium 1 by the compressed air. In this embodiment, the two kinds of solutions flowing through the hoses 2 and 3 are supplied through solenoid valves 126 and 127 to a mixing passage 146 formed in the spray head 5. The solutions are mixed in the mixing passage and the mixed solution is fed therethrough to the nozzles in one direction (that is, in the upward direction in the drawing). The mixing passage is designed so that the mixed solution is prevented from flowing backward (that is, in the downward direction in the drawing).

In the first embodiment, the free terminals of the hoses 2 and 3 are connected to one side wall of the reservoir 22. In this embodiment, the terminals are tightly connected to the bottom of the reservoir 130 as shown in FIG. 6. The reservoir 130 is provided with two highly-functional separation membranes 131 and 132 such as ion-exchange membranes, so that the inner space thereof is partitioned into three spaces through the membranes 131 and 132 to form three chambers for preserving respective solutions for latent image development. The membranes 131 and 132 are formed by reacting a high molecular material such as polyacrylonitrile with a compound having positive or negative charge. In this embodiment, a separation membrane having positive charge is formed by reacting polyacrylonitrile with dimethyl amino and ethyl methacrylate having positive charge and used as an ion-exchange membrane. The membrane thus formed is electrically negatively polarized to allow a positive ion to penetrate therethrough, while it is electrically positively polarized to allow a negative ion to penetrate therethrough. In this embodiment, the three chambers 133, 134 and 135 into which the reservoir 130 is partitioned by the ion-exchange membranes 131 and 132 are used as a toner chamber, a withdrawal chamber and a hardener chamber, respectively. The terminals of the hoses 2 and 3 are connected to sucking members 145 and 144 respectively, which are provided at the bottoms of the hardener and toner chambers 135 and 133, respectively.

An electrode 136 is provided in the toner chamber 133 and a voltage of 5 (v) is applied between the electrode 136 and the ion-exchange membrane 132 such that the potential of the electrode 136 is higher than that of the ion-exchange membrane 132. Similarly, an electrode 137 is provided in the hardener chamber 135 and a voltage of 5 (v) is applied between the electrode 137 and the ion-exchange membrane 131 such that the potential of the electrode 137 is lower than that of the ion-exchange membrane 131.

The toner chamber 133 preserves a nonionic solution 138 (hereinafter referred to as "a first solution") in which negatively-charged toner particles and vehicle (oil-free alkyd resin or the like) are dispersed, and the hardener chamber 135 preserves another nonionic solvent 139 (hereinafter referred to as "a second solution") in which positively-charged hardener (melamine resin or the like) is dispersed.

Unlike the first embodiment of the image forming apparatus, the withdrawing unit of this embodiment is a scraper comprising a rubber type of plate 140 for scraping a surplus wet toner solution on the recording medium 1 in such a manner as to softly stroke the surface of the recording medium 1 which is fed to the rollers 62, and a groove 141 for gathering the scraped toner solution and returning it to the reservoir 130. The scraper is disposed at the downstream side of the spray head 5 in the feeding direction of the recording medium 1. The rollers 62 are disposed at the further downstream side of the scraper 140, and the surface thereof is kept at 200° C. by a controller (not shown). The elements as described above are shielded from light by a shielding member (not shown).

The operation of the image forming apparatus shown in FIG. 5 will be described hereunder.

The recording medium 1 of the roll type sheet which has not yet been exposed to light is uniformly positively charged by the charging device 14 such as a corotron and then is closely attached to the platen 112 in such a manner as to be wound around the platen 12. The semiconductor laser oscillator 116 is controlled by the controller (not shown) to emit a laser beam in synchronism with the rotational motion of the polygon mirror 115. The laser beam emitted from the laser oscillator 116 is reflected from the rotating polygon mirror 115 and is applied to the surface of the recording medium 1 which is closely attached to the platen 112. The laser beam to be applied to the recording medium 1 is scanned in the direction indicated by the arrow B, that is, a main scanning direction by the polygon mirror 115. Accordingly, by the scanning operation of the laser beam in the main scanning direction and an imaginary scanning operation of the laser beam in the auxiliary scanning direction which is performed by the feed of the recording medium 1 in the feeding direction, a latent image corresponding to an original image stored in a frame memory (not shown) is formed on the recording medium 1.

The recording medium 1 having the latent image thereon is vertically downwardly fed to the platen 112 and then the feeding direction thereof is deflected by the platen 112 in the horizontal direction. On the way to the rollers 62, the recording medium 1 is provided with a mixed solution (that is, a wet toner solution) of the first and second solutions 138 and 139 by the spray head 5. The sprayed wet toner solution contains the negatively-charged tone particles and vehicle and the positively-charged hardener. Through the spraying process, the negatively-charged toner particles are electrostatically drawn to the positively charged latent image and fixed thereon. The electrostatic drawing force is dependent on the potential of the latent image, and therefore it is increased as the potential is higher. The recording medium 1 to which the wet toner solution is attached is further fed and the surface thereof is scraped by the scraper 140. Through the scraping operation of the scraper 140, the surplus wet toner solution is removed from the surface of the recording medium 1. The recording medium 1 which is fed to the downstream of the scraper is finally provided with toner particles whose attached portion and amount correspond to the shape and the potential of the latent image, and the latent image is developed. Similarly in the first embodiment, the developed recording medium 1 is fed between the heat rollers 62 and dried thereby at the temperature of 200° C. to heat-fix the recording medium 1.

The surplus wet toner solution scraped by the scraper 140 is dropped down along the inclined wall of the scraper and gathered in the groove portion 141. The gathered wet toner solution is returned to the withdrawing chamber 134 of the reservoir 130 through the groove portion 141. Since the ion-exchange membrane 131 is positively polarized by the voltage applied between the ion-exchange membrane 131 and the electrode 137, the negatively-charged toner particles and vehicle are passed through the ion-exchange membrane 131 to the toner chamber 133. Further, since the other ion-exchange membrane 132 is negatively charged by the voltage applied between the ion-exhange membrane 132 and the electrode 136, the positively-charged hardener is passed through the ion-exchange membrane 132 to the hardener chamber 135. In this process, the non-ionic solvent is freely passed through the ion-exchange membranes 131 and 132. Accordingly, the wet toner solution withdrawn by the scraper 146 can be separated into the first and second solutions and reused as a wet toner solution.

In this embodiment, the first and second solutions are sucked up to the spray head by the sucking members 144 and 145. However, this embodiment is not limited thereto. For example, the solutions may be sucked up by use of a compressed air of the compressor as described in the first embodiment.

Further, this embodiment is described particularly for a case where a monochromatic image is formed. However, similarly to the first embodiment, this embodiment may be applied to a case where a color image is formed. To obtain the color image, the various processes as described above are repeated for each of color latent images.

Still further, in this embodiment, the toners and the vehicle are preserved together in the toner chamber, and the hardener is preserved separately from the toners and the vehicle. However, this embodiment is not limited thereto. For example, it is possible that the toners and the hardener are preserved together in the toner chamber and the vehicle is preserved separately from the toners and the hardener.

In this invention, a well-known stirrer or the like is used to charging toner particles or the like. However, this invention is not limited thereto.

Further, the number and diameter of the nozzles formed on the top surface of the spray head may be changed in accordance with the width of the recording medium, so that the region to which the wet toner solution is sprayed is altered.

According to this invention, the toners and other materials for development of a latent image, such as a solvent for the toners, vehicle, hardener or the like, are separately preserved when the image forming apparatus is not used, and are mixed with each other when the image forming apparatus is used, so that the preservation of the toner solution is stably made and the running cost and the maintenance become lower and easier.

What is claimed is:

1. An image forming apparatus for coating a recording medium having an electrostatic latent image thereon with toners and other components for latent image development to thereby develop the latent image, comprising:

a reservoir for separately preserving a first solution including the toners and a second solution including the other components; and a developing unit means for mixing the first and second solutions to form a wet toner solution and spraying the wet toner solution on the recording medium.

2. An image forming apparatus as claimed in claim 1, wherein the first solution further includes one of hardener and vehicle and the second solution includes the other of hardener and vehicle.

3. An image forming apparatus as claimed in claim 2, wherein said reservoir includes two membranes for partitioning the inner space of said reservoir into first to third chambers, the first and second solutions being separartely preserved in said first and third chambers respectively.

4. An image forming apparatus as claimed in claim 3, further comprising a withdrawing unit for withdrawing a surplus wet toner solution on the recording medium and returning the surplus wet toner solution to said second chamber of said reservoir, the toners and the one of hardener and vehicle in the withdrawn surplus wet toner solution being passed through one of said membranes to said first chamber and the other of hardener and vehicle being passed through the other of said membranes to said third chamber.

5. An image forming apparatus as claimed in claim 3, wherein said membranes comprise ion-exchange membranes for passing positive ions therethrough when negatively polarized and passing negative ions therethrough when positively polarized.

6. An image forming apparatus as claimed in claim 5, wherein the toners and the one of hardener and vehicle are charged at the same polarity and the other of hardener and vehicle is charged at the opposite polarity, and wherein said ion-exchange membranes are kept at predetermined potentials having the opposite polarity to each other.

7. An image forming apparatus as claimed in claim 1, wherein the second solution includes a solvent having low affinity to the recording medium.

8. An image forming apparatus as claimed in claim 7, wherein the solvent is lipophilic.

9. An image forming apparatus as claimed in claim 8, wherein the first solution includes a hydrophilic solvent.

10. An image forming apparatus as claimed in claim 9, further comprising a withdrawing unit for withdrawing a surplus wet toner solution on the recording medium and returning the surplus wet toner solution to said reservoir, the first and second solutions in the surplus wet toner solution being naturally separated into two phases and preserved in said reservoir.

* * * * *